US012111069B1

(12) United States Patent
Kim et al.

(10) Patent No.: US 12,111,069 B1
(45) Date of Patent: Oct. 8, 2024

(54) APPARATUS FOR STABILIZING BLADE FOR RELIEF DAMPER

(71) Applicants: Jin Soo Kim, Goyang-si (KR); Hyun Ok Lee, Goyang-si (KR)

(72) Inventors: Jin Soo Kim, Goyang-si (KR); Hyun Ok Lee, Goyang-si (KR); Sul Ki Kim, Goyang-si (KR)

(73) Assignees: Jin Soo Kim; Hyun Ok Lee

( * ) Notice: Subject to any disclaimer, the term of this patent is extended or adjusted under 35 U.S.C. 154(b) by 0 days.

(21) Appl. No.: 18/704,057

(22) PCT Filed: Nov. 30, 2022

(86) PCT No.: PCT/KR2022/019159
§ 371 (c)(1),
(2) Date: Apr. 24, 2024

(87) PCT Pub. No.: WO2023/101388
PCT Pub. Date: Jun. 8, 2023

(30) Foreign Application Priority Data

Dec. 2, 2021 (KR) ..... 10-2021-0171334

(51) Int. Cl.
*F24F 13/14* (2006.01)

(52) U.S. Cl.
CPC .. *F24F 13/1426* (2013.01); *F24F 2013/1466* (2013.01)

(58) Field of Classification Search
CPC ..... F24F 13/1426; F24F 2013/1466
USPC ..... 137/527.8
See application file for complete search history.

(56) References Cited

U.S. PATENT DOCUMENTS 3,996,961 A * 12/1976 Siegwart ..... F24F 11/745 137/527.8
4,384,672 A * 5/1983 Kutzner ..... F23L 13/02 137/527.8
5,740,834 A * 4/1998 Sherowski ..... B01J 8/003 137/527.6
5,769,573 A * 6/1998 Faas ..... D01G 23/04 137/513.5
5,983,930 A * 11/1999 Nordenberg ..... F23L 3/00 454/259
6,508,246 B1 * 1/2003 Fiedler ..... F23L 13/02 137/520
6,848,468 B1 * 2/2005 Hsien ..... E03F 5/0405 137/527.8

(Continued)

FOREIGN PATENT DOCUMENTS

JP 2002-267034 A 9/2002
KR 10-2009-0046588 A 5/2009

(Continued)

OTHER PUBLICATIONS

International Search Report for PCT/KR2022/019159 mailed Mar. 23, 2023 from Korean Intellectual Property Office.

*Primary Examiner* — Patrick C Williams
(74) *Attorney, Agent, or Firm* — Revolution IP, PLLC

(57) ABSTRACT

Provided is a blade stabilization apparatus for a relief damper, and more specifically, to a blade stabilization apparatus for a relief damper which can stably maintain an opening angle of a damper blade at any angle when the damper opens or closes after the center of gravity is always aligned with a centerline of a rotating shaft in a perpendicular direction to the damper blade.

3 Claims, 5 Drawing Sheets

(56) References Cited

U.S. PATENT DOCUMENTS

2016/0265806 A1 9/2016 Chappell et al.

FOREIGN PATENT DOCUMENTS

| | | | |
|---|---|---|---|
| KR | 10-2010-0004149 | A | 1/2010 |
| KR | 10-0960810 | B1 | 6/2010 |
| KR | 10-0966597 | B1 | 6/2010 |
| KR | 10-0985786 | B1 | 10/2010 |
| KR | 10-2012-0076996 | A | 7/2012 |

* cited by examiner

APPARATUS FOR STABILIZING BLADE FOR RELIEF DAMPER

TECHNICAL FIELD

The present invention relates to a blade stabilization apparatus for a relief damper, and more particularly, to a blade stabilization apparatus for a relief damper which has the center of gravity always positioned above the centerline of a rotating shaft perpendicular to a damper blade, and stably maintains the opening and closing of the damper blade at any angle when the damper blade opens or closes.

BACKGROUND ART

Generally, it is a global trend to install pressure differential smoke control systems using air supply pressurization in special evacuation stairways, vestibules, or emergency elevator platforms of high-rise buildings to protect evacuation routes, which is also regulated by Korean fire safety regulations.

However, when the volume of air supply is excessive, the pressure difference (referred to as 'pressure differential of a smoke control area') between a smoke control area and the area outside the smoke control area becomes so large that it becomes difficult to open doors, which may impede evacuation. Therefore, it is necessary to discharge excessive air supply to maintain the pressure differential of the smoke control area at an appropriate level.

One method to discharge such excessive air supply is the installation of overpressure discharge dampers, and the overpressure discharge dampers should have the following two characteristics.

First, the damper should have a high opening rate. When the opening rate is low, the size of the damper becomes too large relative to the volume of air to be discharged, making installation difficult. Particularly, it is difficult to manufacture a damper of an appropriate size that is suitable for a small space such as a stairway vestibule.

Second, the change in pressure according to the volume of air to be discharged should be small. When the damper is opened by the pressure in the area to discharge air, it is easy to make the damper start opening under the set initially pressure, but it is difficult to make the damper open at an appropriate level according to the internal pressure to maintain the pressure in the area within an appropriate range.

To solve the above problems, the background technology of the present invention includes Korean Patent Publication No. 10-0966597 (hereinafter referred to as Document 1), Korean Patent Publication No. 10-0985786 (hereinafter referred to as Document 2), and Korean Patent Publication No. 10-0960810 (hereinafter referred to as Document 3).

Document 1 relates to an overpressure discharge damper device of an air supply pressurization smoke control system which minimizes casualties by preventing harmful gases and smoke generated during a fire in a high-rise building from entering evacuation routes such as special evacuation stairways, vestibules, emergency elevator platforms, and so on.

Document 1 describes a structure that generates a restoring force using a spring. The opening force acting on the damper blade (a cosine value of the primary side pressure relative to the opening angle) decreases as the opening angle increases. On the other hand, the spring is stretched as the opening angle increases, which results in a greater restoring force. Therefore, to ensure that the opening force increases according to the restoring force that increases depending on the opening angle, the primary side pressure needs to increase by the product of the two factors: cosine value and restoring force. Thus, due to the problems of increased primary side pressure as the damper opens, it is difficult to stabilize the pressure within an appropriate range and obtain a sufficient opening angle.

Document 2 relates to an overpressure discharge damper device of an air supply pressurization smoke control system which minimizes casualties by preventing harmful gases and smoke generated during a fire in a high-rise building from entering evacuation routes such as special evacuation stairways, vestibules, emergency elevator platforms, and so on.

In Document 2, the device minimizes the increase in restoring force according to the opening angle by bending an edge of the blade and limiting the initial set angle to an angle of 10 to 40°. However, a cross-sectional area of the damper becomes smaller by limiting the opening angle to a small range, and thus there is a disadvantage that it is difficult to obtain a sufficient opening area.

Document 3 relates to a mechanical flap damper which includes a flap automatically operated by pressure acting on the flap when the pressure acting on the inside of the damper exceeds the set pressure so as to automatically discharge excess pressure to the outside.

In Document 3, since a combined center of gravity of a blade and a counterweight is between the blade and the counterweight, that is, under a plane parallel to a rotating shaft, several problems arise.

1. Because the force that opens the blade is a cosine value of the primary side pressure relative to the opening angle, at the beginning of opening, whereas the opening force decreases as the opening angle increases, the restoring force due to the rotation of the center of gravity becomes larger. Thus, it is difficult to resolve the problem of an increase in primary side pressure and to obtain a sufficient opening angle.

2. Because the restoring force rapidly decreases as the opening angle increases when the opening angle increases when the center of gravity is above the position parallel to the rotating shaft, the primary side pressure of the damper should become extremely low when the damper is closed before the damper is rapidly closed and severe vibrations are generated.

3. According to the above problems 1 and 2, since deviations occur in the history of primary side pressure changes when the damper is opened and closed, general problems arose in that precise control was not possible.

DISCLOSURE

Technical Problem

The present invention is directed to providing a blade stabilization apparatus for a relief damper, in which the center of gravity of a damper blade is always positioned above the centerline of the rotating shaft perpendicular to the damper blade, and the degree of opening of the damper blade can be stably maintained at any angle when the damper blade opens or closes.

Technical Solution

One aspect of the present invention provides an apparatus including a rotating shaft installed on a relief damper side, and a damper blade which is always balanced on the rotating shaft when no pressure is acting thereon while being horizontally positioned on the rotating shaft, wherein the damper blade opens or closes by itself while rotating about the rotating shaft according to a pressure difference acting on the damper blade when pressure acts on the damper blade.

The damper blade may be made of a flat plate and formed by integrating a first blade which has a long length and is formed on one side and a second blade which has a short length and is formed on the other side.

A weight is added to an upper end of the second blade so that the second blade is in rotational equilibrium with the long first blade.

As a fundamental technical feature of its technical design, the center of gravity of the entire damper blade should be necessarily aligned with the centerline of the rotating shaft perpendicular to the damper blade.

Advantageous Effects

As described above, according to the present invention, when a damper blade is parallel to a rotating shaft, the damper blade is balanced so that the damper blade does not move to one side, and the center of gravity is always positioned on the centerline of the rotating shaft perpendicular to the damper blade.

Therefore, the direction of a load on a surface of the blade is perpendicular to the center of gravity, and the opening force acting on the blade is always balanced with the restoring force applied by a weight regardless of the rotation angle of the blade, and thus the degree of opening of the damper blade can be stably maintained at any angle when the damper opens or closes, and the degree of opening can be greater compared with the related art.

MODES OF THE INVENTION

Exemplary embodiments of the present invention will be illustrated in the accompanying drawings and described in detail in the detailed description, but the embodiments may be changed and have many alternative forms. However, the present invention is not limited to specific embodiments, and it should be understood that the present invention includes all changes, equivalents, and substitutes included in the spirit and technical scope of the present invention. In the description of the present invention, when it is determined that a detailed description of related known technologies may unnecessarily obscure the gist of the present invention, the detailed description will be omitted.

First, the present invention is similar to the related art, in the present invention, the apparatus is also installed and used in a pressure differential smoke control system to appropriately discharge excessively supplied air to special evacuation stairways, vestibules, emergency platforms, and so on of high-rise buildings, thereby maintaining an appropriate pressure differential, preventing harmful gases and smoke from entering evacuation routes, and facilitating the opening of evacuation doors to promote human safety. Also, the apparatus may be also used to stably adjust and maintain pressure in all gas systems, similar to a relief valve that stably adjusts and maintains pressure in liquid systems. For example, the apparatus may be used as a pressure relief device in a gas-based fire extinguishing device protection area.

Therefore, the processes and methods for installation in the system will be omitted below.

Figure 1:
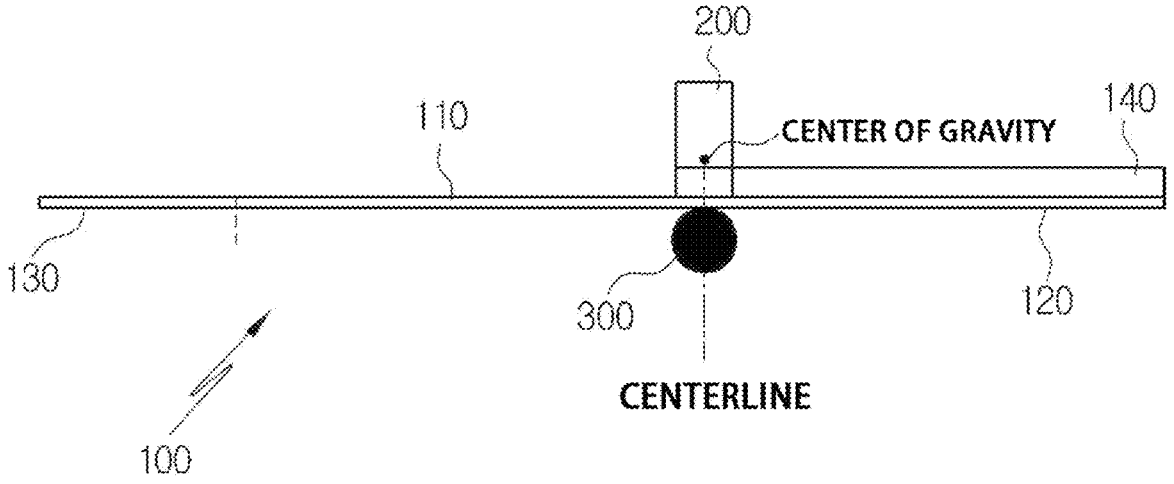
FIG. 1 is a configuration view of a blade stabilization apparatus for a relief damper according to the present invention.

FIG. 1 is a configuration view of a blade stabilization apparatus for a relief damper according to the present invention.

Referring to FIG. 1, the blade stabilization apparatus for a relief damper includes a rotating shaft 300 installed on a relief damper side and a damper blade 100 which is always balanced on the rotating shaft 300 when no pressure is acting thereon while being horizontally positioned on the rotating shaft 300, wherein the damper blade 100 opens or closes while rotating about the rotating shaft 300 according to a pressure difference acting on the damper blade 100 when pressure acts on the damper blade 100.

Opening force: M1 (opening force)

Restoring force: M2 (closing force)

The damper blade 100 is made of a flat plate. In this case, the damper blade 100 is formed as a single piece, and when subdivided, a long first blade 110 formed on one side and a short second blade 120 formed on the other side are integrally formed.

A weight is added to the second blade 120 to adjust the center of gravity with the long first blade 110. A pressure-acting part 130 is formed on an end portion of the first blade 110 to extend therefrom so that the entire damper blade 100 moves and opens when pressure acts thereon.

The center of gravity of the damper blade having the structure of the damper blade 100 is aligned with the centerline of the rotating shaft 300 perpendicular to the damper blade 100, and the damper blade 100 horizontally installed on the rotating shaft 300 is in a state of being horizontally maintained by itself when an external force such as pressure is not acting on it.

Figure 2:
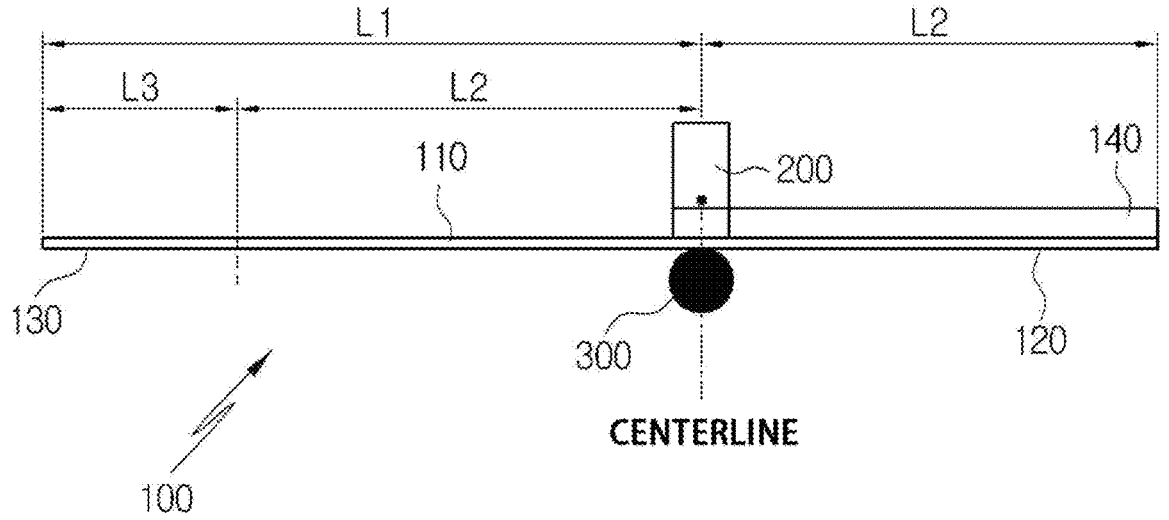
FIG. 2 is a configuration view for describing the blade stabilization apparatus for a relief damper according to the present invention.

FIG. 2 is a configuration view for describing the blade stabilization apparatus for a relief damper according to the present invention.

Referring to FIG. 2, the apparatus will be described in more detail in relation to the length and the mark of the damper blade.

L1: Total length of first blade

L2: Length of second blade

L3: Length of pressure-acting part

As described above, the damper blade 100 has an unbent flat plane shape and includes a first blade 110, a second blade 120, a pressure-acting part 130, and an additional weight 140 which are integrally formed. In this case, the length L1 of the first blade 110 and the pressure-acting part 130 is longer than the length L2 of the second blade 120, and the length L2 of the second blade 120 is the same as the length L2 of the first blade 110.

In this case, because the length L2 of the second blade 120 is smaller than the length L1, the additional weight 140 is used to add weight to the second blade 120, and thus the center of gravity of the entire damper blade is aligned with the centerline of the rotating shaft 300.

The pressure-acting part 130 formed to extend from an end portion of the first blade 110 corresponds to the length L3 and plays an important role in fully opening the damper blade 100 when pressure acts thereon.

Figure 3:
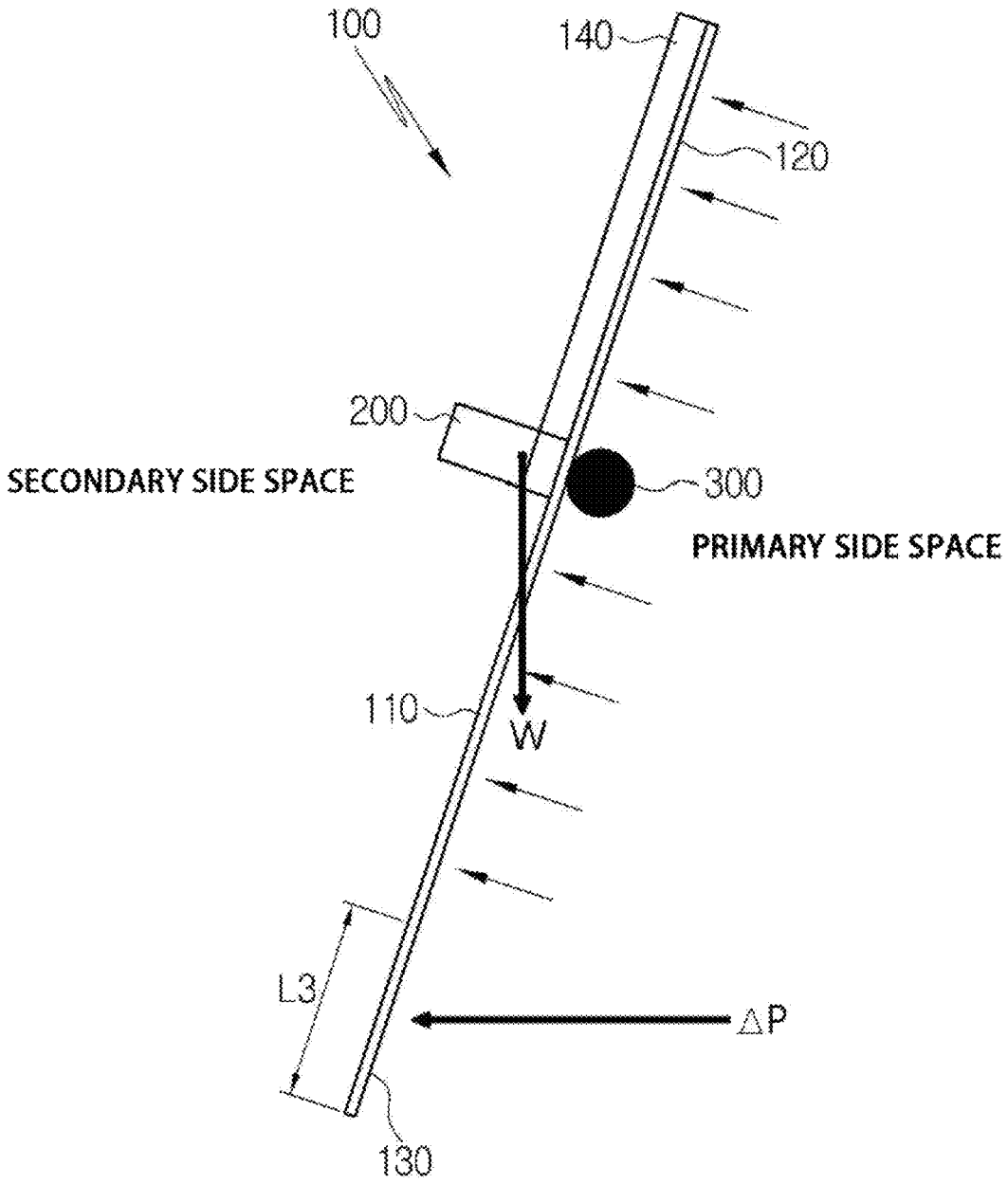
FIG. 3 is a configuration view that illustrates an operating state of the blade stabilization apparatus for a relief damper according to the present invention.

FIG. 3 is a configuration view that illustrates an operating state of the blade stabilization apparatus for a relief damper according to the present invention.

ΔP: Pressure difference

*W: Center of gravity

Referring to FIG. 3, pressure in a primary side space is higher than pressure in a secondary side space, and a pressure difference ΔP is a state in which pressure is evenly acts evenly on the entire surface of the damper blade 100 in the primary side space. Therefore, the pressure acting on the length L2 of the first blade 110 and the pressure acting on the length L1 of the second blade 120 are in equilibrium, but the pressure acting on the pressure-acting part 130 that corresponds to the L3 portion becomes an opening force that moves and rotates the damper blade 100 clockwise.

Meanwhile, the center of gravity W of the damper blade 100 serves as a restoring force that rotates the damper blade 100 in a direction opposite to the action of the pressure and acts counterclockwise. Therefore, when the opening force is greater than the restoring force, the damper blade rotates and opens.

Figure 4:
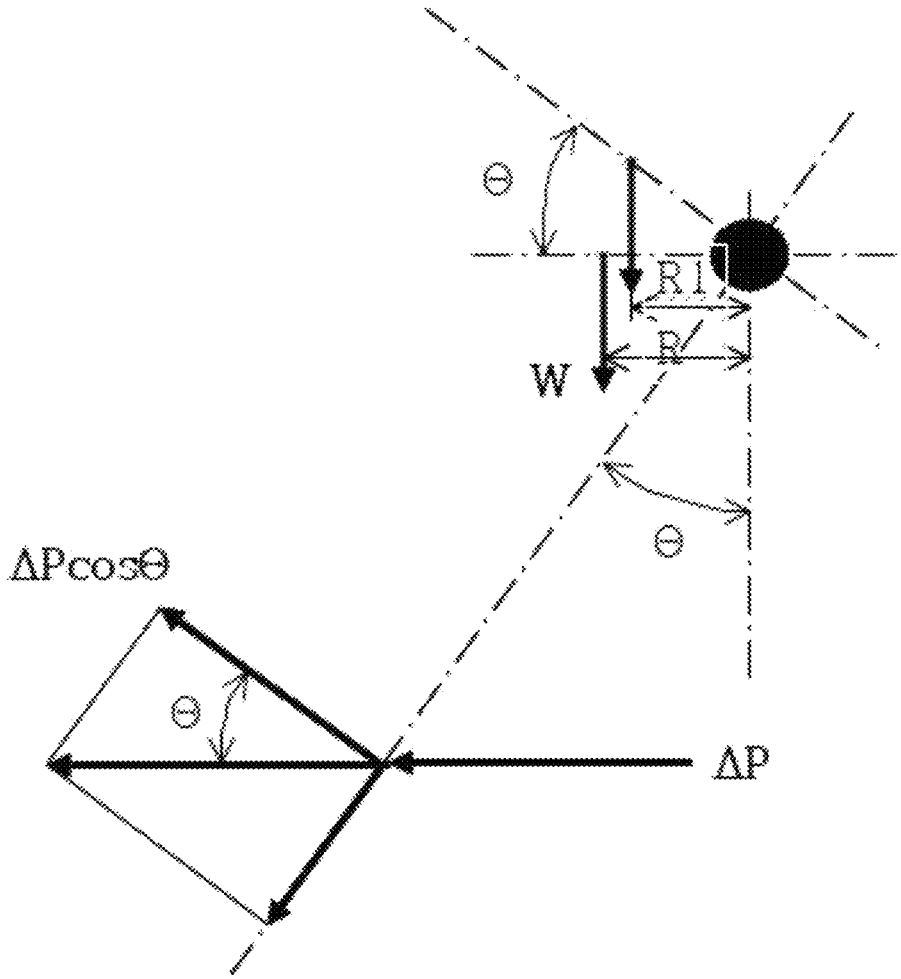
FIG. 4 is a configuration view that illustrates a rotational force relationship of the blade stabilization apparatus for a relief damper according to the present invention.

FIG. 4 is a configuration view that illustrates a rotational force relationship of the blade stabilization apparatus for a relief damper according to the present invention.

Θ: Rotation angle of damper blade

Referring to FIG. 4, the pressure ΔP acting on the pressure-acting part 130 corresponding to the length L3 of the damper blade 100 obliquely acts on a surface of the damper blade 100 as the damper blade 100 rotates. Therefore, a force acting perpendicular to the damper blade 100 is proportional to a cosine value of the rotation angle, i.e., ΔP·cos Θ. However, the distance between the center where pressure acts and the rotating shaft is not changed.

When the distance refers to L, the force (opening force) that rotates the damper blade 100 is as follows.

$$M1=\Delta P\cdot\cos\Theta\cdot L$$

The weight W that causes the center of gravity of the damper blade 100 to reversely rotate the damper blade is not changed, but the distance from the rotating shaft 300 that exerts the rotational force (restoring force) changes from R to R1. In this case, R1 is equal to R·cos Θ. Therefore, the restoring force that causes the center of gravity to reversely rotate the damper blade 100 is as follows.

$$M2=W\cdot R\cos\Theta$$

When the rotational force M1 (opening force) is equal to the rotational force M2 (restoring force), the damper blade 100 stops rotating.

When the primary side pressure ΔP becomes small and M2 is greater than or equal to M1, the damper blade 100 is closed and does not move. As the primary side pressure ΔP increases, at the point where M1 is greater than or equal to M2, the damper blade 100 begins to rotate and open. When the damper blade 100 is opened to discharge pressure so that the pressure ΔP is lowered, the damper blade 100 stops rotating at the angle where M1 and M2 are balanced.

The formula for determining at what pressure the damper blade 100 will be balanced is as follows.

$$M1=M2\rightarrow\Delta P\cdot\cos\Theta\cdot L=W\cdot R\cos\Theta$$

$$\Delta P\cdot L=W\cdot R\rightarrow\Delta P=W\cdot R/L$$

In the above formula, because L is a constant determined by the size of damper blade 100, ΔP may be determined by adjusting the weight W of the counterweight 200 or the distance R from the rotating shaft 300.

That is, as described above, the main point of the present invention is that the center of gravity of the entire damper blade 100 should be always aligned with the centerline of the rotating shaft 300 perpendicular to the damper blade 100, rather than adjusting the counterweight 200.

Because the phenomenon where the position of the equilibrium point between the opening force and the restoring force varies according to the opening angle of the damper blade and the pressure energy acting on the damper blade changes according to the opening angle of the damper blade is not analyzed, in all conventional gravity-type dampers, the relationship between the opening force and the restoring force cannot be explained mathematically. However, in the structure of the present invention, both the opening force M1 and the restoring force M2 of the damper blade 100 are precisely proportional to cos Θ, and thus mathematical interpretation of damper movement is clear, and an opening angle of the damper blade 100 is stably maintained at any angle.

In the result of tests using the damper blade 100 as described above, with an opening angle of 80° and an effective opening of 80% or greater, a much larger degree of opening is achieved compared to the conventional gravity-type dampers, and the variation range of primary side pressure is stable within +6% in all opening angle ranges of 0 to 80° compared to the pressure at which opening starts.

While the center of gravity should be necessarily aligned with the blade in the same direction when viewed from the rotating shaft, the position of the counterweight may be in the opposite direction depending on the damper installation conditions. Therefore, as described above, under the premise that the center of gravity of the entire damper blade 100 should be always aligned with the centerline of the rotating shaft 300 perpendicular to the damper blade 100 and the center of gravity should be in the same direction as the blade when viewed from the rotating shaft, the present invention may be modified to the following structure.

Figure 5:
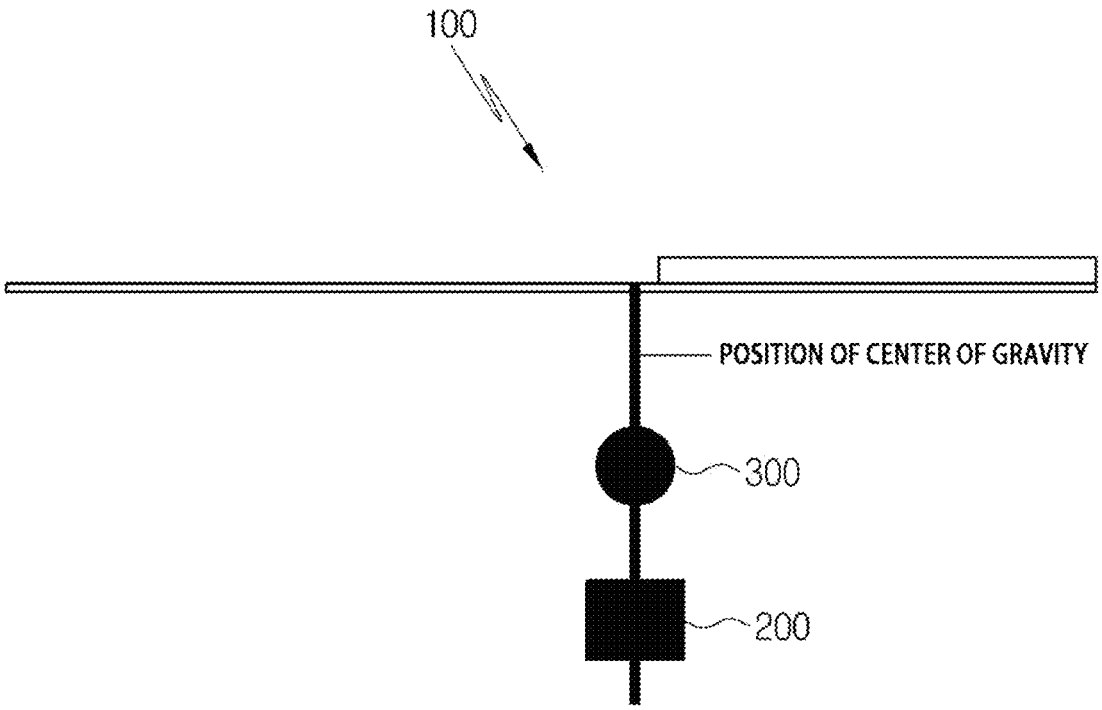
FIG. 5 is another example of a blade stabilization apparatus for a relief damper according to the present invention.
Figure 6:
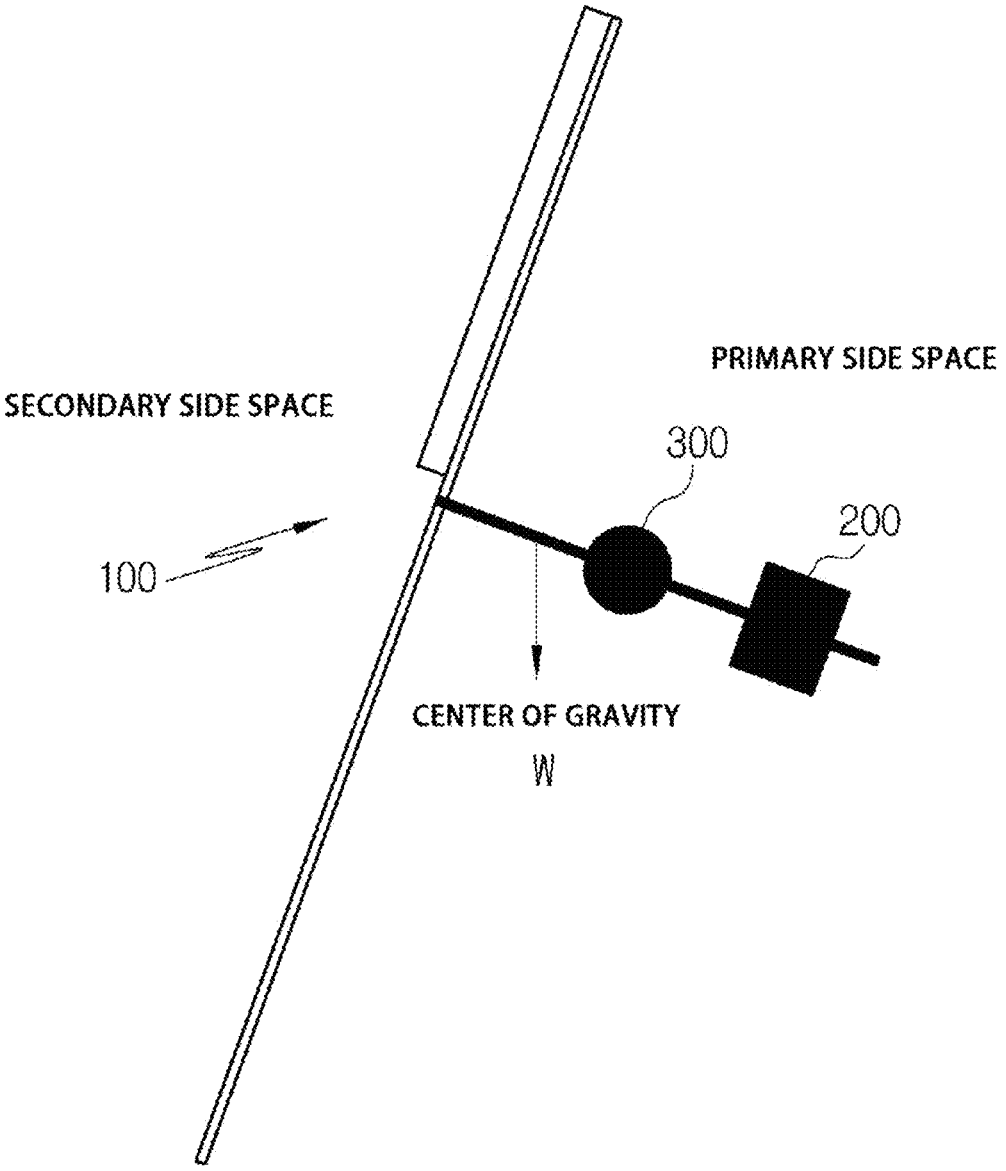
FIG. 6 is another example of a rotational force relationship of the blade stabilization apparatus for a relief damper in FIG. 5.

FIG. 5 is another example of a blade stabilization apparatus for a relief damper according to the present invention, and FIG. 6 is another example of a rotational force relationship of the blade stabilization apparatus for a relief damper in FIG. 5.

When the damper blade 100 is horizontally positioned on the rotating shaft 300 and pressure is not acting thereon, the damper blade 100 is always balanced on the rotating shaft 300. Also, the damper blade 100 opens or closes by itself while rotating about the rotating shaft 300 according to the pressure difference acting on the damper blade 100 when pressure acts on the damper blade 100. Therefore, if the aforementioned conditions are satisfied, a counterweight 200 may be installed and used under the rotating shaft 300, as illustrated in FIGS. 5 and 6.

While the present invention has been particularly described with reference to exemplary embodiments, it should be understood by those of skilled in the art that various changes, modifications, and replacements in form and details may be made without departing from the spirit and scope of the present invention. Therefore, the exemplary embodiments and claims disclosed in the present invention should be considered in a descriptive sense only and not for purposes of limitation. Accordingly, the scope of the present invention is not limited by the embodiments and the accompanying drawings. The scope of the present invention should be defined by the appended claims and encompasses all modifications and equivalents that fall within the scope of the appended claims.

The invention claimed is:

1. A blade stabilization apparatus for a relief damper, comprising:

a rotating shaft installed on a relief damper side;

a damper blade which is always balanced on the rotating shaft when no pressure is acting thereon while being horizontally positioned on the rotating shaft; and a counterweight installed perpendicular to a centerline of the rotating shaft, wherein a center of gravity of the entire damper blade is necessarily aligned with the centerline of the rotating shaft perpendicular to the damper blade, and wherein the damper blade opens or closes by itself while rotating about the rotating shaft according to a pressure difference acting on the damper blade when pressure acts on the damper blade.

2. The apparatus of claim 1, wherein the damper blade is formed by integrating a first blade which has a long length and is formed on one side with a second blade which has a short length and is formed on the other side centered on the rotating shaft, and a weight is added to an upper end of the second blade to match a center of gravity of the second blade with that of the first blade which has the long length.

3. The apparatus of claim 1, wherein the counterweight is installed on a lower end of the rotating shaft.

* * * * *